US010301090B2

(12) United States Patent
Holley, Jr.

(10) Patent No.: US 10,301,090 B2
(45) Date of Patent: May 28, 2019

(54) CARRIER FOR CONTAINERS

(71) Applicant: Graphic Packaging International, Inc., Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 372 days.

(21) Appl. No.: 15/364,770

(22) Filed: Nov. 30, 2016

(65) Prior Publication Data

US 2017/0152091 A1 Jun. 1, 2017

Related U.S. Application Data

(60) Provisional application No. 62/261,436, filed on Dec. 1, 2015.

(51) Int. Cl.
*B65D 71/36* (2006.01)
*B65D 5/10* (2006.01)
(Continued)

(52) U.S. Cl.
CPC ..... *B65D 71/36* (2013.01); *B31B 50/60* (2017.08); *B31B 50/74* (2017.08); *B65D 5/106* (2013.01);
(Continued)

(58) Field of Classification Search
CPC ..... B65D 71/36; B65D 5/106; B65D 5/4266; B65D 71/004; B31B 50/60
(Continued)

(56) References Cited

U.S. PATENT DOCUMENTS 2,222,211 A 11/1940 Arneson
2,225,822 A 12/1940 Crook
(Continued)

FOREIGN PATENT DOCUMENTS

DE 90 04 439 6/1990
EP 0 822 150 A1 2/1998
(Continued)

OTHER PUBLICATIONS

European Search Report for EP 16 20 1615 dated Mar. 14, 2017.

*Primary Examiner* — King M Chu
(74) *Attorney, Agent, or Firm* — Womble Bond Dickinson (US) LLP

(57) ABSTRACT

A carrier for holding a plurality of containers is disclosed. The carrier includes a plurality of panels that extends at least partially around an interior of the carrier. The plurality of panels includes at least one bottom panel, at least one top panel, a front panel, a back panel, at least one side panel, and at least one central panel that divides the interior of the carrier into a front portion and a back portion. At least one divider flap is foldably connected to the at least one central panel and extends to one of the front panel and the back panel to divide one of the front portion and the back portion into at least two container-receiving spaces. The at least one top panel is foldably connected to at least one of the front panel and the back panel and includes at least one opening for receiving a container of the plurality of containers. The at least one top panel comprises a locking tab and the at least one central panel comprises a locking opening for receiving the locking tab.

35 Claims, 9 Drawing Sheets

(51) Int. Cl.

| | |
|---|---|
| ***B65D 5/42*** | (2006.01) |
| ***B65D 5/46*** | (2006.01) |
| ***B65D 5/48*** | (2006.01) |
| ***B65D 71/62*** | (2006.01) |
| ***B31B 50/60*** | (2017.01) |
| ***B31B 50/74*** | (2017.01) |
| *B31B 50/86* | (2017.01) |
| *B31B 50/81* | (2017.01) |
| *B31B 100/00* | (2017.01) |
| *B31B 50/73* | (2017.01) |
| *B31B 120/20* | (2017.01) |

(52) U.S. Cl.
CPC ..... *B65D 5/4266* (2013.01); *B65D 5/46088* (2013.01); *B65D 5/48016* (2013.01); *B65D 71/004* (2013.01); *B65D 71/0037* (2013.01); *B31B 50/732* (2017.08); *B31B 50/81* (2017.08); *B31B 50/86* (2017.08); *B31B 2100/00* (2017.08); *B31B 2120/20* (2017.08); *B65D 2571/0016* (2013.01); *B65D 2571/0029* (2013.01); *B65D 2571/0037* (2013.01); *B65D 2571/0045* (2013.01); *B65D 2571/0066* (2013.01); *B65D 2571/00339* (2013.01); *B65D 2571/00456* (2013.01); *B65D 2571/00487* (2013.01); *B65D 2571/00574* (2013.01); *B65D 2571/00728* (2013.01); *B65D 2571/00734* (2013.01); *B65D 2571/00753* (2013.01)

(58) Field of Classification Search
USPC ..... 206/193
See application file for complete search history.

(56) References Cited

U.S. PATENT DOCUMENTS

| | | | |
|---|---|---|---|
| 2,227,330 | A | 12/1940 | Turner |
| 2,331,312 | A | 10/1943 | Dorfman |
| 2,336,857 | A | 12/1943 | Gies et al. |
| 2,457,308 | A | 12/1948 | Hall et al. |
| 2,460,108 | A | 1/1949 | Smith et al. |
| 2,660,361 | A | 11/1953 | Tyrseck |
| 2,689,061 | A | 9/1954 | Gray |
| 2,721,001 | A | 10/1955 | Hasselhoff |
| 2,772,020 | A | 11/1956 | Kramer |
| 2,776,072 | A | 1/1957 | Forrer |
| 2,783,916 | A | 3/1957 | Hodapp |
| 2,991,908 | A | 7/1961 | Conescu |
| 2,993,619 | A | 7/1961 | Arneson |
| 3,029,977 | A | 4/1962 | Arneson |
| 3,053,411 | A | 9/1962 | Struble et al. |
| 3,128,906 | A | 4/1964 | Forrer |
| 3,190,487 | A | 6/1965 | Wood |
| 3,191,800 | A | 6/1965 | Kowal |
| 3,194,478 | A | 7/1965 | Weiss |
| 3,229,849 | A | 1/1966 | Spillson |
| 3,236,414 | A | 2/1966 | Slevin, Jr. |
| 3,313,466 | A | 4/1967 | Keith |
| 3,343,742 | A | 9/1967 | Siegler |
| 3,352,452 | A | 11/1967 | Graser |
| 3,432,073 | A | 3/1969 | Forrer |
| 3,554,401 | A | 1/1971 | Wood |
| 3,624,790 | A | 11/1971 | Stout |
| 3,651,982 | A | 3/1972 | Slevin |
| 3,661,297 | A | 5/1972 | Wood |
| 3,669,306 | A | 6/1972 | Forrer |
| 3,672,539 | A | 6/1972 | Forrer |
| 3,709,400 | A | 1/1973 | Arneson |
| 3,721,335 | A | 3/1973 | Grant |
| 3,722,738 | A | 3/1973 | Wright |
| 3,739,940 | A | 6/1973 | Harrelson |
| 3,754,680 | A | 8/1973 | Wood |
| 3,757,991 | A | 9/1973 | Stout |
| 3,784,053 | A | 1/1974 | Stout |
| 3,860,113 | A | 1/1975 | Helms |
| 3,893,565 | A | 7/1975 | Rossi et al. |
| 3,917,059 | A | 11/1975 | Wood |
| 3,917,060 | A | 11/1975 | Wood |
| 3,917,061 | A | 11/1975 | Stout |
| 4,000,813 | A | 1/1977 | Stout |
| 4,010,847 | A | 3/1977 | Wood et al. |
| 4,029,205 | A | 6/1977 | Wood |
| 4,153,158 | A | 5/1979 | Graser et al. |
| 4,171,046 | A | 10/1979 | Bonczyk |
| 4,187,944 | A | 2/1980 | Wood |
| 4,205,748 | A | 6/1980 | Wilson |
| 4,217,983 | A | 8/1980 | Stout |
| 4,243,138 | A | 1/1981 | Wilson |
| 4,250,992 | A | 2/1981 | Gilbert |
| 4,253,564 | A | 3/1981 | Engdahl, Jr. |
| 4,308,950 | A | 1/1982 | Wood |
| 4,318,470 | A | 3/1982 | Montealegre |
| 4,319,682 | A | 3/1982 | Wright et al. |
| 4,362,240 | A | 12/1982 | Elward |
| 4,374,561 | A | 2/1983 | Stout et al. |
| 4,377,252 | A | 3/1983 | Schillinger |
| 4,406,365 | A | 9/1983 | Kulig |
| 4,413,729 | A | 11/1983 | Wood |
| 4,450,956 | A | 5/1984 | Wood |
| 4,469,222 | A | 9/1984 | Graser |
| 4,480,746 | A | 11/1984 | Wood |
| 4,482,055 | A | 11/1984 | Boyle |
| 4,509,640 | A | 4/1985 | Joyce |
| 4,544,092 | A | 10/1985 | Palmer |
| 4,591,090 | A | 5/1986 | Collins et al. |
| 4,610,349 | A | 9/1986 | Schwartz et al. |
| 4,722,437 | A | 2/1988 | Walsh |
| 4,770,294 | A | 9/1988 | Graser |
| 4,782,943 | A | 11/1988 | Blackman |
| 4,782,944 | A | 11/1988 | Engdahl, Jr. |
| 4,792,038 | A | 12/1988 | Cooper |
| 4,927,009 | A | 5/1990 | Stout |
| 5,029,698 | A | 7/1991 | Stout |
| 5,040,672 | A | 8/1991 | DeMaio et al. |
| 5,072,876 | A | 12/1991 | Wilson |
| 5,123,588 | A | 6/1992 | Harris |
| 5,161,732 | A | 11/1992 | Clein et al. |
| 5,167,325 | A | 12/1992 | Sykora |
| 5,191,976 | A | 3/1993 | Stout et al. |
| 5,246,113 | A | 9/1993 | Schuster |
| 5,282,348 | A | 2/1994 | Dampier et al. |
| 5,359,830 | A | 11/1994 | Olson et al. |
| 5,363,954 | A | 11/1994 | Dampier et al. |
| 5,400,901 | A | 3/1995 | Harrelson |
| 5,439,110 | A | 8/1995 | Regan, II |
| 5,458,234 | A | 10/1995 | Harris |
| 5,482,203 | A | 1/1996 | Stout |
| 5,484,053 | A | 1/1996 | Harris |
| 5,499,712 | A | 3/1996 | Harrelson |
| 5,518,110 | A | 5/1996 | Harrelson |
| 5,531,319 | A | 7/1996 | Harrelson |
| 5,538,130 | A | 7/1996 | Harrelson |
| 5,538,131 | A | 7/1996 | Harrelson |
| 5,547,074 | A | 8/1996 | Plaxico et al. |
| 5,579,625 | A | 12/1996 | Olson et al. |
| 5,590,762 | A | 1/1997 | Harrelson |
| 5,593,027 | A | 1/1997 | Sutherland |
| 5,611,425 | A | 3/1997 | Holley, Jr. |
| 5,620,094 | A | 4/1997 | Naumann |
| 5,638,956 | A | 6/1997 | Sutherland |
| 5,645,162 | A | 7/1997 | Harrelson |
| 5,649,620 | A | 7/1997 | Harrelson |
| 5,657,864 | A | 8/1997 | Harrelson |
| 5,657,865 | A | 8/1997 | Harrelson |
| 5,680,930 | A | 10/1997 | Stone |
| 5,682,982 | A | 11/1997 | Stonehouse |
| 5,682,985 | A | 11/1997 | Plaxico et al. |
| 5,695,051 | A | 12/1997 | Hart |
| 5,709,298 | A | 1/1998 | Harris |
| 5,765,685 | A | 6/1998 | Roosa |
| 5,775,487 | A | 7/1998 | Harrelson |
| 5,819,920 | A | 10/1998 | Sutherland |

(56) References Cited

U.S. PATENT DOCUMENTS

| | | | | |
|---|---|---|---|---|
| 5,848,695 | A | 12/1998 | Harris et al. | |
| 5,855,316 | A | 1/1999 | Spivey | |
| 5,871,090 | A | 2/1999 | Doucette et al. | |
| 5,878,877 | A | 3/1999 | Sutherland | |
| 5,884,756 | A | 3/1999 | Holley, Jr. et al. | |
| 5,941,377 | A | 8/1999 | Hart et al. | |
| 5,947,273 | A | 9/1999 | Dalrymple et al. | |
| 6,003,665 | A | 12/1999 | Stout | |
| 6,041,920 | A | 3/2000 | Hart et al. | |
| 6,112,977 | A | 9/2000 | Sutherland et al. | |
| 6,131,729 | A | 10/2000 | Eckermann et al. | |
| 6,155,962 | A | 12/2000 | Dalrymple et al. | |
| 6,168,013 | B1 | 1/2001 | Gomes | |
| 6,230,881 | B1 | 5/2001 | Collura | |
| 6,247,585 | B1 | 6/2001 | Holley, Jr. | |
| 6,315,111 | B1 | 11/2001 | Sutherland | |
| 6,321,906 | B1 | 11/2001 | Wein | |
| 6,341,689 | B1 | 1/2002 | Jones | |
| 6,371,287 | B1 | 4/2002 | Jones et al. | |
| 6,571,941 | B2 | 6/2003 | Holley, Jr. | |
| 6,695,137 | B2 | 2/2004 | Jones et al. | |
| 6,736,260 | B2 | 5/2004 | Gomes et al. | |
| 6,802,802 | B2 | 10/2004 | Woog | |
| 6,814,228 | B2 | 11/2004 | Sutherland | |
| 6,938,756 | B2 | 9/2005 | Schuster | |
| 7,011,209 | B2 * | 3/2006 | Sutherland | B65D 71/30 206/175 |
| 7,025,197 | B2 | 4/2006 | Sutherland | |
| 7,070,045 | B2 | 7/2006 | Theelen | |
| 7,128,206 | B2 | 10/2006 | Kohler | |
| 7,134,547 | B2 | 11/2006 | Auclair | |
| 7,207,934 | B2 | 4/2007 | Schuster | |
| 7,234,596 | B2 | 6/2007 | Lebras | |
| 7,374,038 | B2 | 5/2008 | Smalley | |
| 7,448,492 | B2 | 11/2008 | Sutherland | |
| 7,472,791 | B2 | 1/2009 | Spivey, Sr. | |
| 7,552,820 | B2 | 6/2009 | Kohler | |
| 7,604,116 | B2 | 10/2009 | Schuster | |
| 7,644,817 | B2 | 1/2010 | Sutherland | |
| 7,677,387 | B2 | 3/2010 | Brand et al. | |
| 7,762,395 | B2 | 7/2010 | Sutherland et al. | |
| 7,762,397 | B2 | 7/2010 | Coltri-Johnson et al. | |
| 7,793,780 | B2 | 9/2010 | Smalley | |
| 7,959,062 | B2 | 6/2011 | Auclair | |
| 8,020,695 | B2 | 9/2011 | Brand | |
| 8,297,437 | B2 | 10/2012 | Smalley et al. | |
| 8,622,207 | B2 | 1/2014 | Smalley | |
| 9,415,914 | B2 | 8/2016 | Holley, Jr. | |
| 2002/0077236 | A1 | 6/2002 | Chalendar et al. | |
| 2002/0117407 | A1 | 8/2002 | Holley | |
| 2003/0111363 | A1 | 6/2003 | Theelen | |
| 2003/0159950 | A1 | 8/2003 | Jones et al. | |
| 2003/0213705 | A1 | 11/2003 | Woog | |
| 2004/0026269 | A1 | 2/2004 | Cuomo | |
| 2004/0050722 | A1 | 3/2004 | Schuster | |
| 2004/0094435 | A1 | 5/2004 | Auclair et al. | |
| 2005/0167292 | A1 | 8/2005 | Sutherland | |
| 2005/0211577 | A1 | 9/2005 | Bakx | |
| 2005/0218014 | A1 | 10/2005 | Schuster | |
| 2005/0230273 | A1 | 10/2005 | Kohler | |
| 2006/0091024 | A1 | 5/2006 | Cuomo | |
| 2006/0148629 | A1 | 7/2006 | Cuomo | |
| 2006/0157545 | A1 | 7/2006 | Auclair | |
| 2006/0231440 | A1 | 10/2006 | Holley, Jr. | |
| 2007/0000980 | A1 | 1/2007 | Oliveira | |
| 2007/0017839 | A1 | 1/2007 | Sutherland | |
| 2007/0029212 | A1 | 2/2007 | Smalley | |
| 2007/0151873 | A1 | 7/2007 | Schuster | |
| 2008/0210581 | A1 | 9/2008 | Brand | |
| 2008/0265008 | A1 | 10/2008 | Holley | |
| 2009/0008273 | A1 | 1/2009 | Smalley | |
| 2010/0006458 | A1 | 1/2010 | Wilkins et al. | |
| 2010/0072086 | A1 | 3/2010 | Smalley | |
| 2011/0048975 | A1 | 3/2011 | Brand | |
| 2012/0000913 | A1 | 1/2012 | Smalley et al. | |
| 2014/0291386 | A1 | 10/2014 | Ikeda | |

FOREIGN PATENT DOCUMENTS

| | | | |
|---|---|---|---|
| EP | 1 319 607 | | 6/2003 |
| EP | 1 365 970 | A2 | 12/2003 |
| EP | 1 852 359 | | 11/2007 |
| EP | 2 102 073 | | 9/2010 |
| FR | 2 825 074 | | 11/2002 |
| GB | 926874 | | 5/1963 |
| WO | WO 97/05026 | | 2/1997 |
| WO | WO 99/01356 | | 1/1999 |
| WO | WO 02/068280 | A2 | 9/2002 |
| WO | WO 2006/020525 | | 2/2006 |
| WO | WO 2007/070668 | A2 | 6/2007 |
| WO | WO 2008/089124 | | 7/2008 |
| WO | WO 2010/048126 | A1 | 4/2010 |

* cited by examiner

CARRIER FOR CONTAINERS

CROSS-REFERENCE TO RELATED APPLICATION

The present application claims the benefit of U.S. Provisional Patent Application No. 62/261,436 filed on Dec. 1, 2015.

INCORPORATION BY REFERENCE

The disclosure of U.S. Provisional Patent Application No. 62/261,436, filed on Dec. 1, 2015, is hereby incorporated by reference for all purposes as if presented herein it its entirety.

BACKGROUND OF THE DISCLOSURE

The present disclosure generally relates to carriers or cartons for holding and displaying containers. More specifically, the present disclosure relates to basket-style carriers.

SUMMARY OF THE DISCLOSURE

According to one aspect, a carrier for holding a plurality of containers is disclosed. The carrier comprises a plurality of panels that extends at least partially around an interior of the carrier. The plurality of panels comprises at least one bottom panel, at least one top panel, a front panel, a back panel, at least one side panel, and at least one central panel dividing the interior of the carrier into a front portion and a back portion. At least one divider flap is foldably connected to the at least one central panel and extends to one of the front panel and the back panel to divide one of the front portion and the back portion into at least two container-receiving spaces. The at least one top panel is foldably connected to at least one of the front panel and the back panel and includes at least one opening for receiving a container of the plurality of containers. The at least one top panel comprises a locking tab and the at least one central panel comprises a locking opening for receiving the locking tab.

According to another aspect of the disclosure, a blank for forming a carrier for holding a plurality of containers is disclosed. The blank comprises a plurality of panels for extending at least partially around an interior of the carrier formed from the blank and comprising at least one bottom panel, at least one top panel, a front panel, a back panel, at least one side panel, and at least one central panel for dividing the interior of the carrier formed from the blank into a front portion and a back portion. At least one divider flap is foldably connected to the at least one central panel and is for extending to one of the front panel and the back panel to divide one of the front portion and the back portion into at least two container-receiving spaces in the carrier formed from the blank. The at least one top panel is foldably connected to at least one of the front panel and the back panel and includes at least one opening for receiving a container of the plurality of containers. The blank comprises locking feature including a locking tab in the at least one top panel and a locking opening in the at least one central panel for receiving the locking tab in the carrier formed from the blank.

According to another aspect of the disclosure, a method of forming a carrier for holding a plurality of containers is disclosed. The method comprises obtaining a blank having a plurality of panels that comprises at least one bottom panel, at least one top panel, a front panel, a back panel, at least one side panel, and at least one central panel, at least one divider flap foldably connected to the at least one central panel and extending to one of the front panel and the back panel, the at least one top panel is foldably connected to at least one of the front panel and the back panel and includes at least one opening for receiving a container of the plurality of containers. The blank comprises locking features comprising a locking tab in the at least one top panel and a locking opening in the at least one central panel. The method comprises positioning the plurality of panels to extend at least partially around an interior of the carrier, positioning the at least one central panel to divide the interior of the carrier into a front portion and a back portion, positioning the at least one divider panel to extending to one of the front panel and the back panel to divide one of the front portion and the back portion into at least two container-receiving spaces, and activating the locking features to lock the at least one top panel. The activating the locking features comprises inserting the locking tab into the locking opening.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENT

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles) at least partially disposed within the carrier embodiments. In this specification, the terms "lower," "bottom," "upper," "top," "front," and "back" indicate orientations determined in relation to fully erected carriers.

Figure 1:
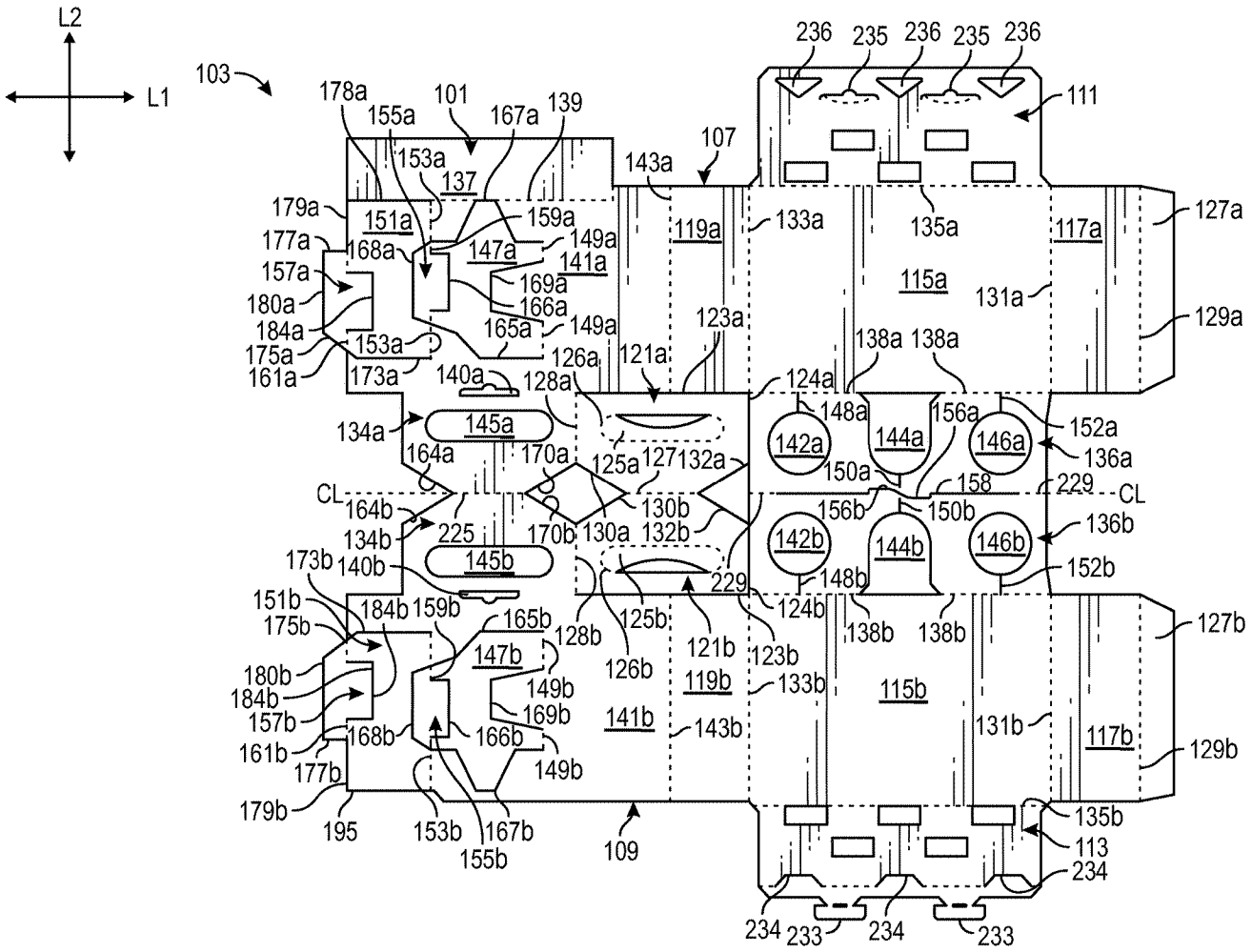
FIG. 1 is a top plan view of a blank for forming a carrier according to one embodiment of the disclosure.
Figure 7:
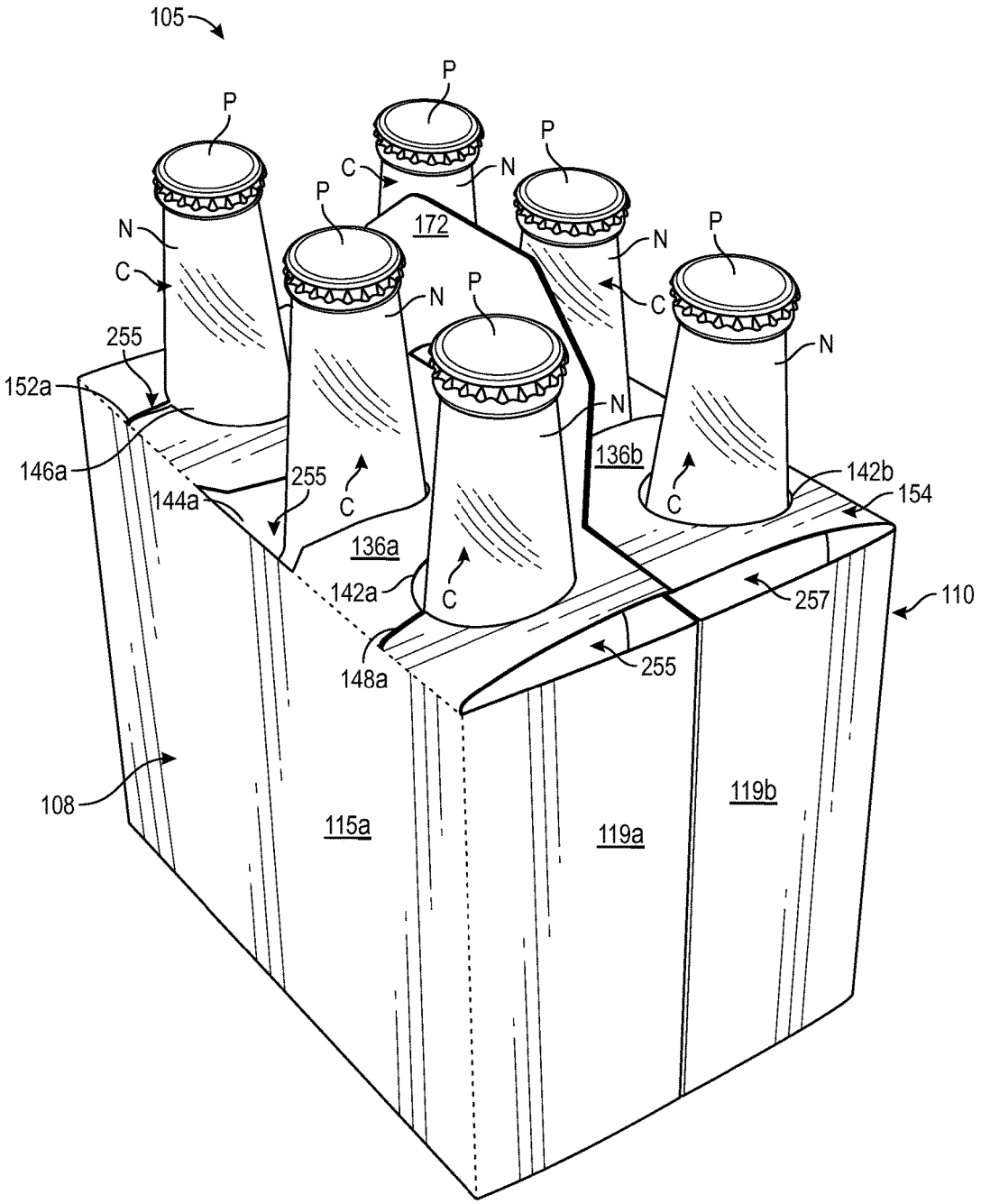
FIG. 7 is a sixth sequential view of an assembly of the blank of FIG. 1, showing a fully formed carrier.

FIG. 1 is a plan view of an interior side 101 of a blank 103 used to form a package or basket-style carrier 105 (FIG. 7), in accordance with an exemplary embodiment of the present disclosure. With reference to FIGS. 1 and 7, the carrier 105 is sized to contain six containers C, three containers being contained in a front portion 108 of the carrier 105 and three containers being contained in a back portion 110 of the carrier 105. In the illustrated embodiment, the containers C are beverage bottles with necks N, or the like, that extend upwardly to just below the caps P of the containers C, but the containers C could be any other suitable type and size of container without departing from the disclosure. The carrier 105 may be sized and shaped to hold more or less than six containers C. As will be discussed in greater detail below, the carrier 105 includes a four-ply handle 172 for grasping the carrier 105 and top panels 136*a*, 136*b* having pilfer-proof or pilfer detection features for controlling product removal and providing visual tamper evidence as well as locking features for facilitating formation of the carrier and maintaining the top panels in place.

The blank 103 has a longitudinal axis L1 and a lateral axis L2. The blank 103, as shown, has a front portion 107 for forming the front portion of the carrier 105, a back portion 109 for forming the back portion 110 of the carrier, a bottom panel 111 foldably connected to the front portion 107, and a bottom connective flap 113 foldably connected to the back portion 109. In the illustrated embodiment, the front portion 107 and back portion 109 are for being folded about a longitudinal centerline CL of the blank 103 when the blank 103 is formed into the carrier 105. The bottom panel 111 and the connective flap 113 may be oppositely arranged without departing from the disclosure. As discussed in more detail below, the blank 103 is formed into the carrier 105 by folding the blank 103 about the centerline CL so that the front portion 107 and the back portion 109 are overlapped.

In the illustrated embodiment, the front portion 107 comprises a front panel 115*a* foldably connected to a first side panel 117*a* and a second side panel 119*a*. Lateral fold lines 131*a*, 133*a*, foldably connect a respective first and second side panel 117*a*, 119*a* to the front panel 115*a*. As shown, the front panel 115*a* is connected to the bottom panel 111 along a longitudinal fold line 135*a*. An adhesive flap 127*a* is foldably connected to the first side panel 117*a* at a lateral fold line 129*a*.

The front portion 107 also includes a front handle panel 121*a* adjacent the second side panel 119*a* along a cut 123*a* extending in parallel with axis L1. The front handle panel 121*a* is separated from the second side panel 119*a* by the cut 123*a*. The front handle panel 121*a* includes a handle flap 125*a* foldably connected to the front handle panel 121*a* at a fold line 126*a*. The handle flap 125*a* may be an arcuate member that defines an at least partial opening, as shown.

In one embodiment, and as shown, the front portion 107 includes a front or first central panel 141*a* foldably connected to the second side panel 119*a* at a lateral fold line 143*a*. The central panel 141*a* includes a keel 137 foldably connected to the central panel 141*a* at a longitudinal fold line 139, an opening 140*a*, and handle features for forming handle 172 (FIG. 7). The handle features include a handle portion 134*a* of the central panel 141*a* that includes a handle opening 145*a*. The front handle panel 121*a* is foldably connected to the handle portion 134*a* of the first central panel 141*a* at a lateral fold line 128*a*. The front handle panel 121*a* includes generally oblique outer edges 130*a*, 132*a* extending from the edges of respective fold line 128*a* and a cut line 124*a* associated with top panel 136*a*. The handle features also include oblique edges 164*a*, 170*a* of the handle portion 134*a* in the first central panel 141*a* that have a same or similar configuration to the oblique edges 130*a*, 132*a* of the front handle panel 121*a* such that when the blank 103 is formed into the carrier 105 the oblique edges 164*a*, 170*a*, 130*a*, 132*a* provide a shape to the handle 172 that facilitates positioning the handle 172 in the formed carrier 105, as described further herein.

Figure 7A:
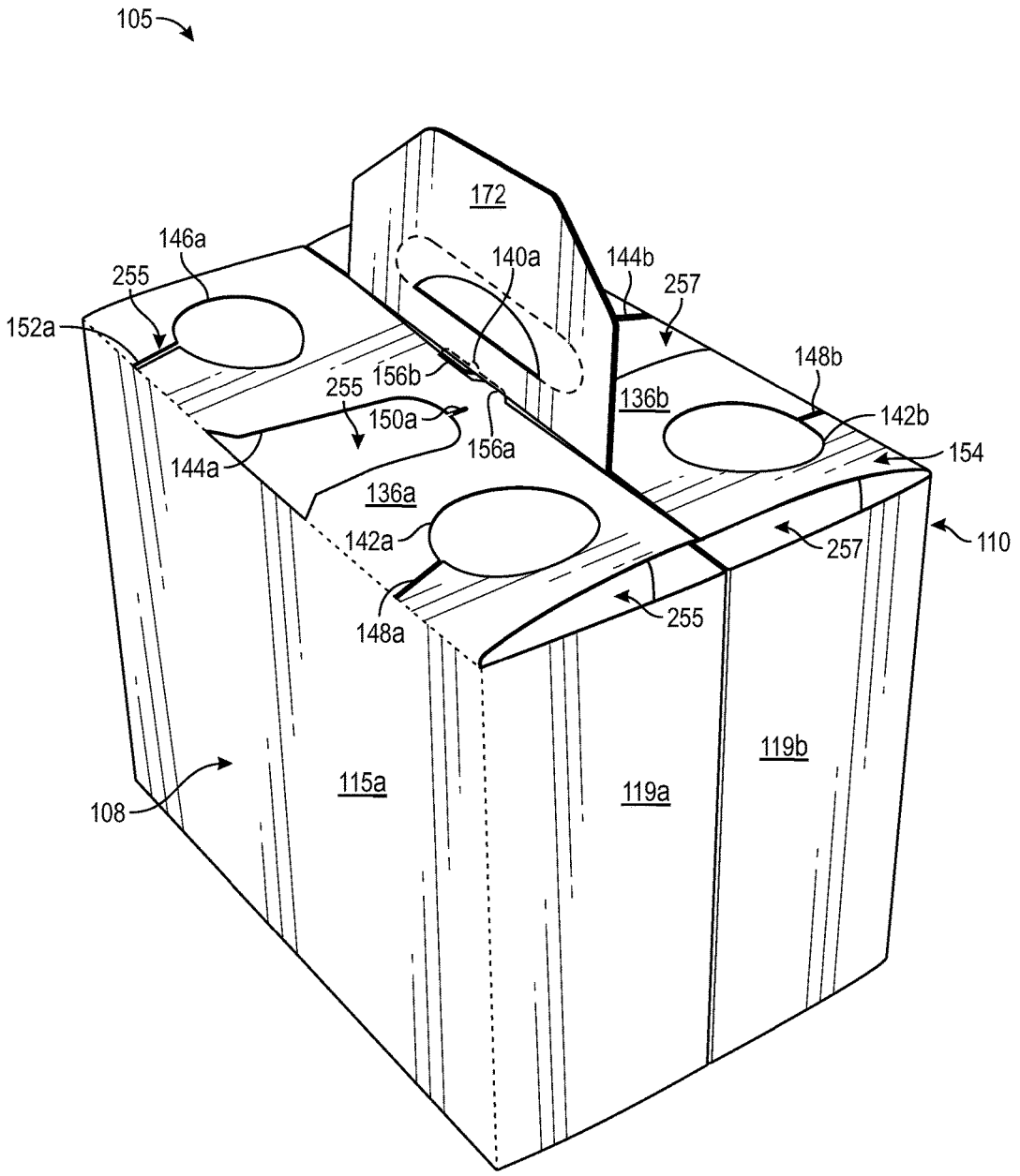
FIG. 7A is a perspective of the carrier with containers removed.
Figure 8:
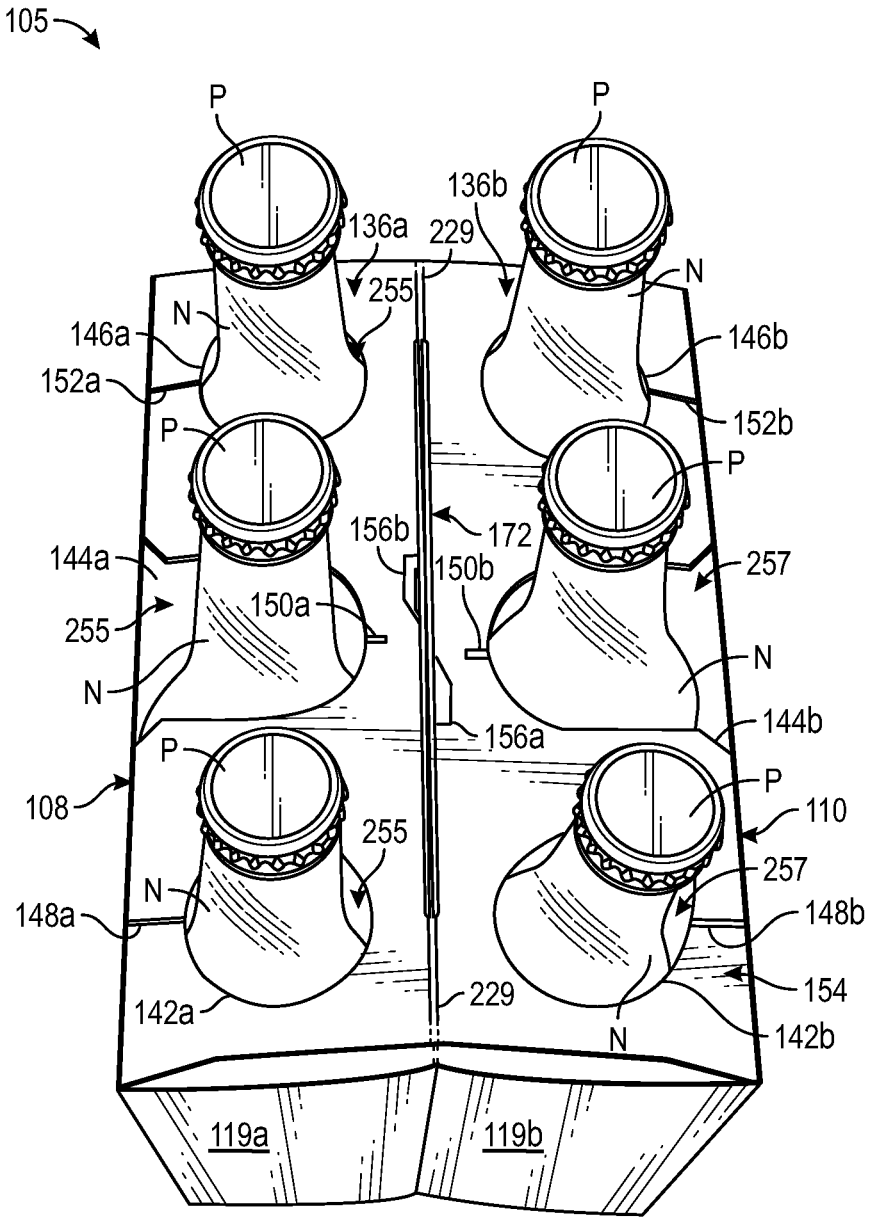
FIG. 8 is a top plan view of the carrier of FIG. 7.

Still referring to FIG. 1, the front portion 107 of blank 103 also includes a first top panel 136*a* foldably connected to the front panel 115*a* at longitudinal fold line 138*a*. The first top panel 136*a* is partially defined by a longitudinal cut 158 that extends at least partially along centerline CL, as described further herein. The first top panel 136*a* is also separated from the handle panel 121*a* by the lateral cut 124*a*. In the illustrated embodiment, the first top panel 136*a* includes three openings 142*a*, 144*a*, 146*a* for receiving the necks N of the containers C (FIG. 7). In one embodiment, openings 142*a*, 146*a* are circular and the opening 144*a* includes a semi-circular portion and a generally rectangular portion extending from the semi-circular portion to the front panel 115*a* and intersecting the fold line 138*a*. The openings 142*a*, 144*a*, 146*a* may be alternatively shaped, arranged, or configured without departing from the disclosure. The openings 142*a*, 144*a*, 146*a* include a respective expansion cut 148*a*, 150*a*, and 152*a* (broadly "expansion feature") extending from the openings 142*a*, 144*a*, 146*a* to provide controlled or guided tearing of the carrier 105 and removal of the containers C. In one embodiment, expansion cuts 148*a*, 152*a* extend toward fold line 138*a* and expansion cut 150*a* extends toward cut 158 and/or the centerline CL. The top panel 136*a* may also include a tab 156*a* formed along the cut 158 for mating with the opening 140*a* in the first central panel 141*a* to hold the carrier 105 in the upright and fully erect position as shown in FIGS. 7, 7A, and 8.

In one embodiment, and as shown in FIG. 1, a first divider flap 147*a* is foldably connected to the first central panel 141*a* at a lateral fold line 149*a*. A second divider flap 151*a* is foldably connected to the first central panel 141*a* at a lateral fold line 153*a*. Each divider flap 147*a*, 151*a* includes a respective attachment flap 155*a*, 157*a* foldably connected to the respective divider flap at a lateral fold line 159*a*, 161*a*. The first divider flap 147*a* is at least partially defined by an upper cut 165*a*, a lower cut 167*a*, a side cut 169*a*, and the lateral fold line 149*a*. The first attachment flap 155*a* is at least partially defined by upper cuts 165*a*, lower cuts 167*a*, lateral cuts 166*a*, 168*a*, and lateral fold lines 159*a*. The second divider flap 151*a* is at least partially defined by an upper cut 173*a* that extends from a lateral edge of the blank 103 to the fold line 153*a*, an upper edge 175*a*, a lower cut 178*a* that extend from a lateral edge of the blank 103 to the fold line 153*a*, and an upper lateral edge 180*a* and a lower lateral edge 179*a* corresponding to a lateral edge of the blank 103, and the lateral fold line 153*a*. As shown, the lower cut 178*a* of the second divider flap 151*a* may be collinear with the longitudinal fold line 139 associated with keel 137. The second attachment flap 157*a* is at least partially defined by the upper edge 175*a*, a lower edge 177*a*, a cut 184*a*, the upper lateral edge 180*a*, and lateral fold line 161*a*. In this regard, the first and second divider flaps 147*a*, 151*a* are at least partially separable from the first central panel 141*a* and may be at least partially surrounded by the first central panel 141*a*.

In the illustrated embodiment, the features of the back portion 109 of the blank 103 include a back panel 115*b*, a first side panel 117*b*, a second side panel 119*b*, a second top panel 136*b*, a back handle panel 121*b*, and a central adhesive flap 127*b* that are generally a mirror-image of the corresponding panel or flap of the front portion 107. Corresponding components and features (e.g., panels, flaps, fold lines, cuts, etc.) have been designated by corresponding reference numbers that differ by the "a" or "b" suffix, with the "a" components corresponding to the front portion 107 and the "b" components corresponding to the back portion 109 of the blank 103.

As shown in FIG. 1, the back portion 109 includes a back or second central panel 141*b* foldably connected to the fourth side panel 119*b* at a lateral fold line 143*b*. The central panel 141*b* includes a handle portion 134*b* with a handle opening 145*b*, and an opening 140*b* for at least partially receiving the tab 156*b* of the top panel 136*b*. A third divider flap 147*b* is foldably connected to the back central panel 141*b* at a lateral fold line 149*b*. A fourth divider flap 151*b* is foldably connected to the back central panel 141*b* at a lateral fold line 153*b*. Each divider flap 147*b*, 151*b* includes a respective adhesive flap 155*b*, 157*b* foldably connected to the respective divider flaps 147*b*, 151*b* at lateral fold lines 159*b* and 161*b*. The third divider flap 147*b* is at least partially defined by an upper cut 165*b*, a lower cut 167*b*, a side cut 169*b*, and the lateral fold lines 149*b*. The third attachment flap 155*b* is at least partially defined by the lower cuts 167*b*, the upper cuts 165*b*, side cuts 166*b*, 168*b* and lateral fold lines 159*b*. The fourth divider flap 151*b* is at least partially defined by an upper cut 173*b* that extends from a lateral edge of the blank 103 to the fold line 153*b*, an upper edge 175*b*, a lower edge 195, an upper lateral edge 180*b* and a lower lateral edge 179*b* corresponding to a lateral edge of the blank 103, and the lateral fold line 153*b*. The fourth attachment flap 157*b* is at least partially defined by the upper edge 175*b*, a lower edge 177*b*, a side cut 184*b*, the upper lateral edge 180*a*, and lateral fold line 161*b*. In this regard, the third and fourth divider flaps 147*b*, 151*b* are at least partially separable from the second central panel 141*b* and may be at least partially surrounded by the second central panel 141*b*.

In the illustrated embodiment, the blank 103 includes a longitudinal fold line 225 that foldably connects the front central panel 141*a* and the back central panel 141*b*. Also, a longitudinal fold line 227 foldably connects the front handle panel 121*a* and the back handle panel 121*b*. A longitudinal fold line 229 foldably connects the first top panel 136*a* to the second top panel 136*b*. Portions of the longitudinal fold line 229 extend from respective ends of the cut 158. The cut 158 extends between portions of the first top panel 136*a* and the second top panel 136*b* and defines respective locking tabs 156*a*, 156*b* that are formed in respective adjacent edges of the first top panel and the second top panel. In the illustrated embodiment, the longitudinal fold lines 225, 227, 229 are generally aligned with the longitudinal centerline CL of the blank 103 and portions of the cut 158 that are adjacent the respective locking tabs 156*a*, 156*b* are generally aligned with the longitudinal centerline CL of the blank.

Any of the panels, flaps, fold lines, cuts, or other features could be otherwise shaped, arranged, and/or omitted from the blank 103 without departing from the disclosure. The blank 103 could be sized and/or shaped to accommodate more or less than six containers without departing from this disclosure.

Figure 2:
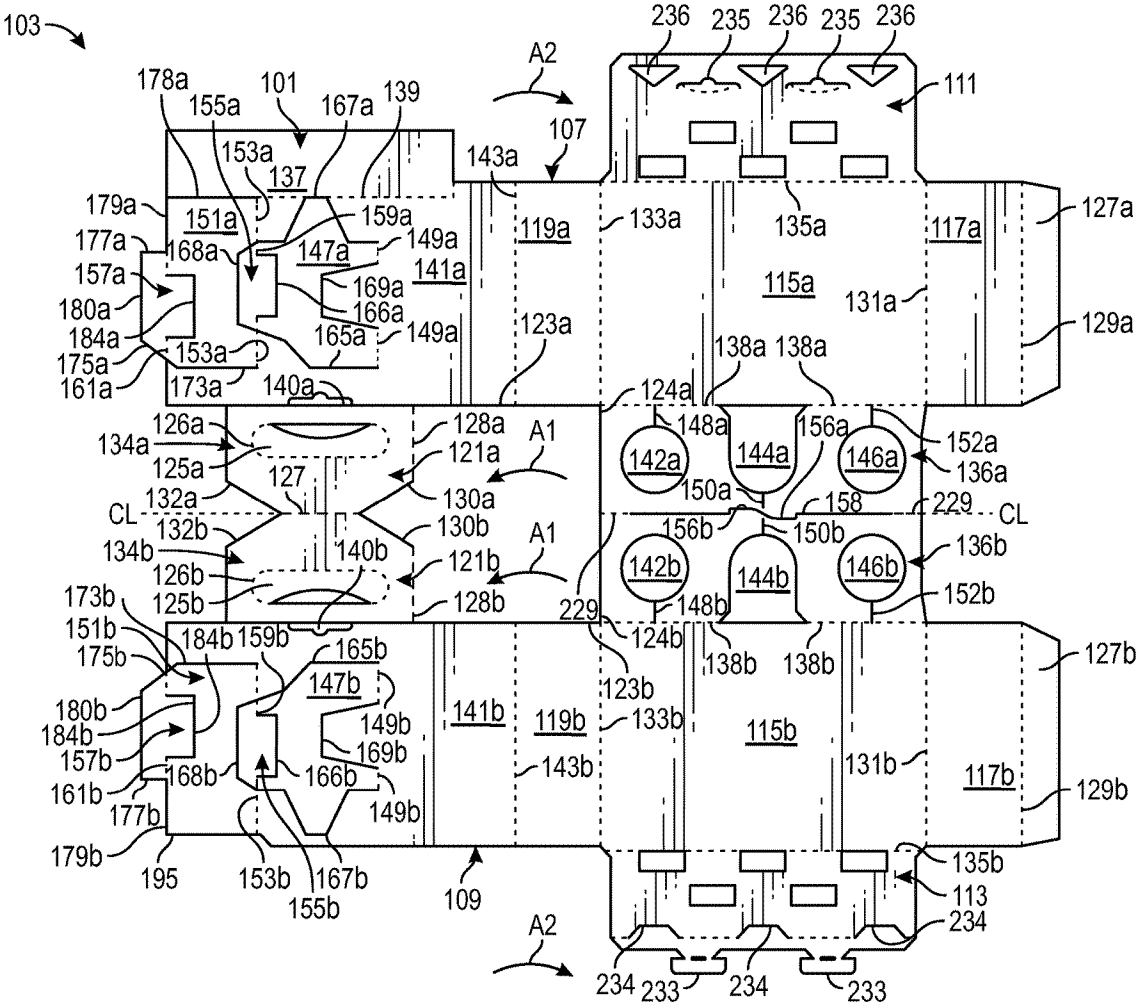
FIG. 2 is first sequential view of an assembly of the blank of FIG. 1.

Still referring to FIG. 1, and referring additionally to FIG. 2, in one exemplary method of forming the carrier 105, the carrier 105 may be erected from the blank 103 by respectively folding the handle panels 121*a*, 121*b* in the direction of A1 along fold lines 128*a*, 128*b* so that the respective oblique edges 130*a* and 170*a*, 132*a* and 164*a*, 130*b* and 170*b*, and 132*b* and 164*b* are aligned and the handle panels 121*a*, 121*b* are in adjacent the central panels 141*a*, 141*b* along a line parallel to axis L1.

Figure 3:
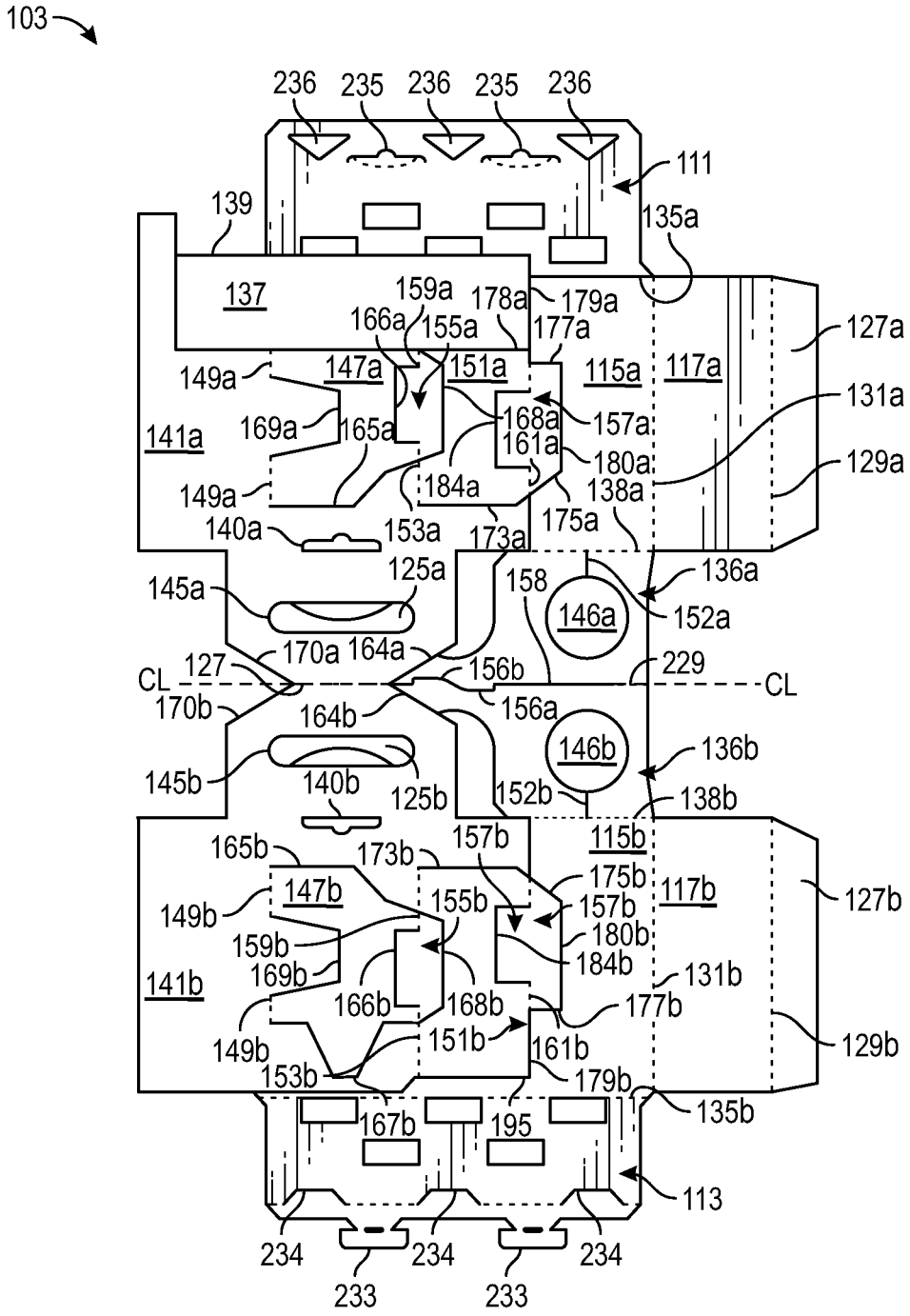
FIG. 3 is a second sequential view of an assembly of the blank of FIG. 1.

Still referring to FIGS. 1 and 2, and referring additionally to FIG. 3, the method includes folding the central panels 141*a*, 141*b* in the direction of arrows A2 (FIG. 2) about fold lines 143*a*, 143*b* so that the central panels 141*a*, 141*b* are in an overlying face-to-face relationship with portions of the handle panels 121*a*, 121*b* and are adjacent the front and back panels 151*a*, 151*b* along a line parallel to axis L2. Glue or other adhesive is selectively applied to the blank 103 to adhesively connect the attachment flaps 155*a*, 157*a* to the front panel 115*a* with glue and to adhesively connect the adhesive flaps 155*b*, 157*b* to the back panel 115*b*. The keel 137 may also be folded about fold line 139 to be in overlying face-to-face contact and adhesively connected with an exterior surface 101 of the blank 103 along central panel 141*a*, as illustrated.

Figure 4:
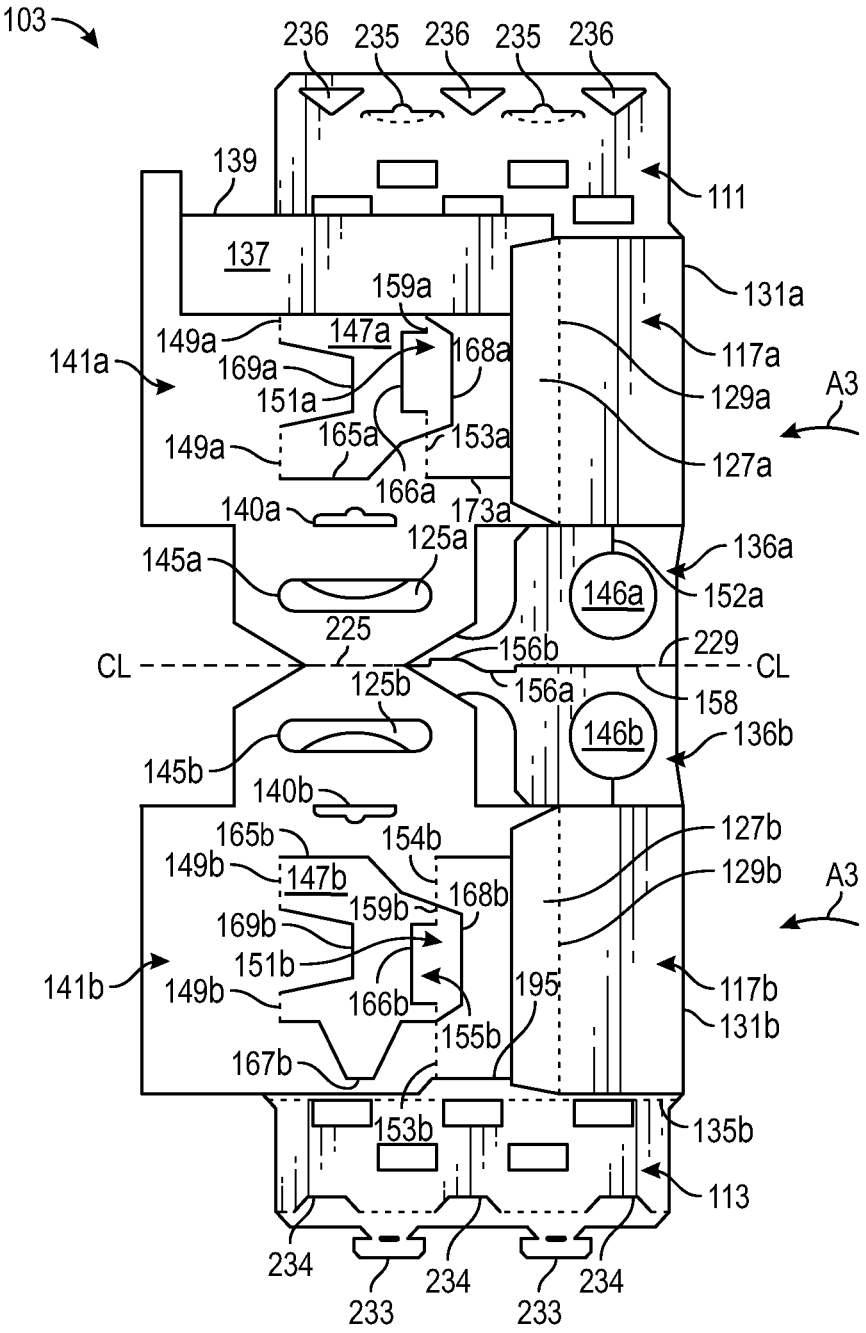
FIG. 4 is a third sequential view of an assembly of the blank of FIG. 1.

Still referring to FIGS. 1 and 3, and referring additionally to FIG. 4, as shown, the side panels 117*a*, 117*b* are folded in the direction of arrows A3 about fold lines 131*a*, 131*b* so that the side panels 117*a*, 117*b* and respective adhesive flaps 127*a*, 127*b* are in overlying face-to-face contact with portions of the central panels 141*a*, 141*b* and the central panels 141*a*, 141*b* can be selectively adhesively secured thereto, for example, with glue.

Figure 5:
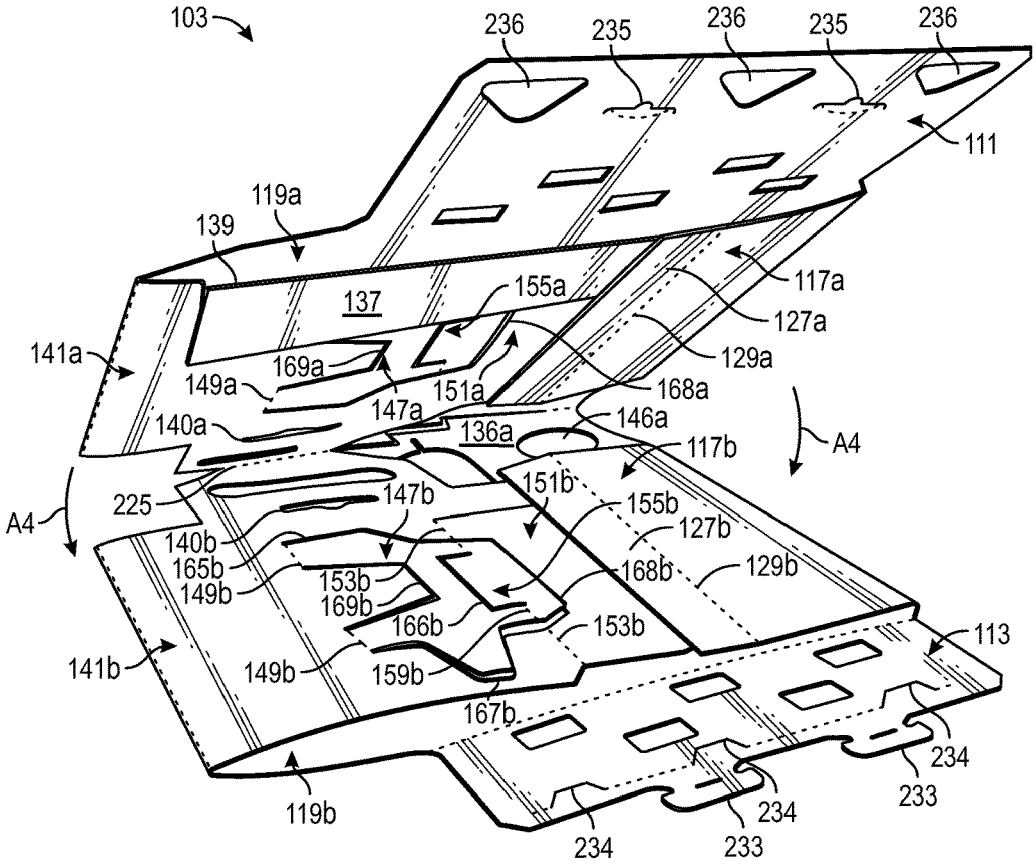
FIG. 5 is a fourth sequential view of an assembly of the blank of FIG. 1.

Next, still referring to FIGS. 1 and 4, and referring additionally to FIG. 5, the partially assembled blank 103 is folded in the direction of arrow A4 (FIG. 5) about the longitudinal centerline CL so that the front portion 107 is in overlying face-to-face contact with the back portion 109.

Figure 6:
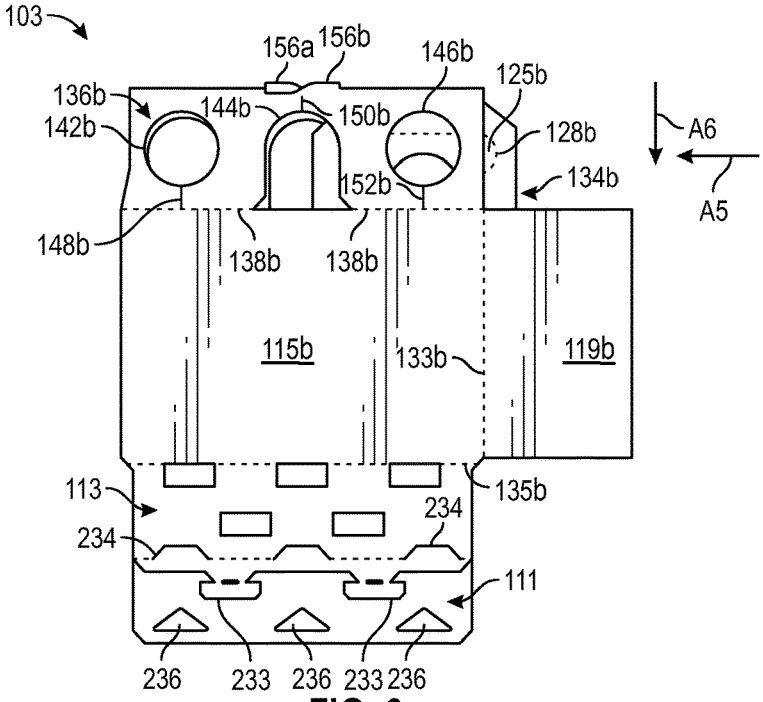
FIG. 6 is a fifth sequential view of an assembly of the blank of FIG. 1.

Referring additionally to FIGS. 6-8, the blank 103 is further assembled into the carrier 105 by positioning the first side panels 117*a*, 117*b* and second side panels 119*a*, 119*b* to be in a generally spaced-apart, parallel planar relationship and positioning the front panel 115*a* and back panel 115*b* to be in a generally spaced-apart, parallel planar relationship. Such movement of the side panels 117*a*, 117*b*, 119*a*, 119*b* and front and back panels 115*a*, 115*b*, causes the handle 172 and top panels 136*a*, 136 to move from a first position (FIG. 6) wherein the handle 172 is generally parallel to and between the top panels 136*a* and 136*b* that are folded about fold line 229, to a second position (FIG. 7) wherein the top panels 136*a*, 136*b* are downwardly folded about fold lines 138*a*, 138*b* to extend between the top of the front panel 115*a* and back panel 115*b*. As the top panels 136*a*, 136*b* are moved to the position of FIG. 6 to the position of FIG. 7, handle 172 is moved to the left in the direction of arrow A5 (FIG. 6) so that the overlapped handle panels 121*a*, 121*b* and overlapped central panels 141*a*, 141*b* that form the handle 172 are inserted through the cut 158 between the two top panels 136*a*, 136*b* as the top panels are moved downward in the direction of arrow A6 (FIG. 6). The aligned oblique edges 130*a* and 170*a*, 132*a* and 164*a*, 130*b* and 170*b*, and 132*b* and 164*b* of central panels 141*a*, 141*b* and handle panels 121*a*, 121*b* may facilitate the insertion of handle 172 through cut 158, for example, by reducing catching or interference of the outer edges of handle 172 with portions of top panels 136*a*, 136*b*. As the top panels 136*a*, 136*b* and the handle 172 are positioned, the locking tabs 156*a*, 156*b* of the top panels 136*a*, 136*b* will engage the overlapped locking openings 140*a*, 140*b* in the overlapped central panels 141*a*, 141*b* to lock the top panels 136*a*, 136*b* in the position of FIGS. 7, 7A, and 8 so that the top panels 136*a*, 136*b* are generally planar relative to each other to form a top panel 154 of the carrier 105 that is generally perpendicular to the front and back panels 115*a*, 115*b* and side panels 117*a*, 117*b*, 119*a*, 119*b*. As shown, the positioning of the side panels 117*a*, 117*b*, 119*a*, 119*b* and front and back panels 115*a*, 115*b*, causes the divider flaps 147*a*, 151*a* in the front portion 108 of the carrier 105 to be positioned generally perpendicular with the front panel 115*a* to divide the front portion into three container-receiving spaces 255. Similarly, the rear portion 110 of the carrier 105 is divided into three container receiving spaces 257 by the divider flaps 147*b*, 151*b*. The bottom panel 111 and bottom connective flap 113 are folded and partially overlapped and locked to form an enclosed bottom of the carrier 105, as described further herein.

The top panel of the carrier 105 is arranged such that the container receiving spaces 255, 257 are at least partially enclosed by the respective top panels 136*a*, 136*b*. While the openings 142*a*, 144*a*, 146*a*, 142*b*, 144*b*, 146*b* permit the partial protrusion, e.g., of necks N, of containers C above the top panels 136*a*, 136*b*, the top panels 136*a*, 136*b* are configured to be torn proximate the openings 142*a*, 144*a*, 146*a*, 142*b*, 144*b*, 146*b* in order to remove containers C from the container receiving spaces 255, 257. Such tearing of top panels 136*a*, 136*b* may be facilitated by expansion features such as expansion cuts 148*a*, 150*a*, and 152*a* adjacent openings 142*a*, 144*a*, 146*a* and expansion features such as expansion cuts 148*b*, 150*b*, and 152*b* adjacent openings 142*b*, 144*b*, 146*b*. Upon tearing of portions of top panels 136*a*, 136*b*, visual evidence is provided such that it will be readily apparent that a container C has been removed from one or more particular container receiving space 255, 257. In this regard, tearing of portions of top panels 136*a*, 136*b* as described herein may discourage or minimize the unauthorized removal of one or more containers C from carrier 105. For example, the added step of tearing or breaching portions of top panels 136*a*, 136*b* may influence the behavior of one or more persons who may desire to remove one or more containers C without authorization. Such unauthorized removal of containers C from a carrier 105 may occur, for example, in shelves or refrigerated cases in retail locations, e.g., convenience stores, grocery stores, or gas stations, in which persons may remove selected containers from carriers in order to mix-and-match with or to fill a different carrier of containers. The expansion features 148*a*, 148*b*, 150*a*, 150*b*, 152*a*, 152*b* could be other lines of weakening other than cuts (e.g., tear lines, cut/crease lines, notches, slits, openings, etc.) and could be otherwise shaped such as to be other than straight lines without departing from the disclosure.

Figure 9:
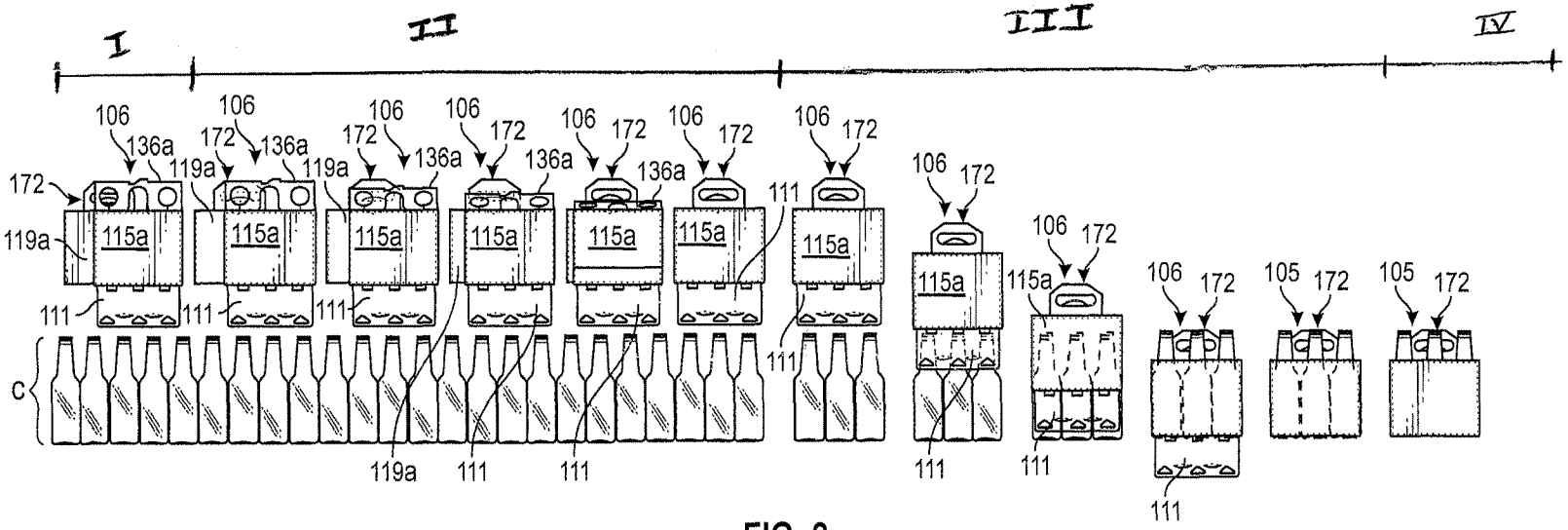
FIG. 9 is a side view of a loading and assembly operation of the carrier.

Still referring to FIGS. 7 and 8, and referring additionally to the product loading section of FIG. 9, loading and assembly of carriers 105 are illustrated according to an exemplary embodiment of the disclosure. Open bottomed carriers 106, e.g., carriers 105 as described herein and having a disconnected and spaced apart bottom panel 111 and bottom connective flap 113 is fed over a grouping of six containers C. In embodiments, the open bottomed carriers 106 may be moved along an overhead carrier assembly (not shown) in concert with the groups of containers C carried along a conveyor or belt (not shown). FIG. 9 illustrates the various stages of the loading and assembly of the carrier 105 in sequence from left to right. At the upstream end, is the carton infeed stage I where the partially assembled blank 103 or open bottomed carrier 106 is fed to the forming area in the folded flat configuration generally illustrated in FIG. 6. The carton opening stage II is adjacent the carton infeed stage and the folded flat, open bottomed carrier 106 of the carton infeed stage is progressed through a folding/positioning apparatus (not shown) and opened by positioning the front and back panels 115*a*, 115*b* and side panels 117*a*, 117*b*, 119*a*, 119*b* relative to each other, downwardly folding the top panels 136*a*, 136*b*, and positioning the handle panel to be inserted through the cut 158 between the top panels 136*a*, 136*b*. In the carton opening stage II, the locking tabs 156*a*, 156*b* are inserted through the overlapped locking openings 145*a*, 145*b* in the central panels 141*a*, 141*b* to lock the top panels 136*a*, 136*b* in the opened configuration of the open bottomed carrier 106 so that the container receiving spaces 255, 277 are formed. Next, the open bottomed carrier 106 is conveyed to the product loading stage III, wherein the open bottom carrier 106 from the discharge of the carton opening stage II is lowered onto a group of six containers C. As shown in FIG. 9, the open-bottomed carriers 106 are lowered onto groups of containers C during the product loading stage III so that the containers C enter a respective container-receiving space 255, 257 and each container C extends through an opening 142*a*, 144*a*, 146*a* and 142*b*, 144*b*, 146*b* in the respective top panels 136*a*, 136*b*. After the containers C are fully inserted, the bottom connective flap 113 is connected to the bottom panel 111, for example, by glue or by mechanical attachment wherein the bottom connective flap 113 comprises locking portions 233, 234 which interlock with respective openings or cuts 235 and openings 236. In embodiments, locking portions 233, 234 may be tabs as illustrated, or may have a different configuration for interengagement with openings or cuts 235 and openings 236. At the end of the product loading stage III, the bottom of the carrier 105 is closed and the bottoms of the containers C are supported by the bottom wall formed from the bottom panel 111 and bottom connective flap 113 of the carrier 105. After the product loading stage III, the loaded and closed carrier 105 is conveyed at the product outfeed stage IV to a location for further processing such as loading for bulk shipment. The stages I, II, III, IV of the formation and loading of the carrier 105 from the blank 103 are exemplary and one or more of the stages could be modified, and/or omitted without departing from the disclosure.

The exemplary carrier embodiments described herein accommodates six containers C arranged in two rows, but the present disclosure is not limited to these numbers. As one example, additional containers may be accommodated by increasing the size of the blank 103 (e.g., in the longitudinal direction L1 in FIG. 1) and forming additional container-receiving spaces therein. Also, the blank 103 could have less than six container-receiving spaces.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, comprising:

a plurality of panels that extends at least partially around an interior of the carrier and comprising at least one bottom panel, at least one top panel, a front panel, a back panel, at least one side panel, and at least one central panel dividing the interior of the carrier into a front portion and a back portion; and at least one divider flap foldably connected to the at least one central panel and extending to one of the front panel and the back panel to divide one of the front portion and the back portion into at least two container-receiving spaces, the at least one top panel is foldably connected to at least one of the front panel and the back panel and includes at least one opening for receiving a container of the plurality of containers, the at least one top panel comprises a locking tab and the at least one central panel comprises a locking opening for receiving the locking tab.

2. The carrier of claim 1, wherein the at least one top panel comprises a first top panel foldably connected to the front panel and a second top panel foldably connected to the back panel, the locking tab comprises a first locking tab extending from the first top panel and a second locking tab extending from the second top panel.

3. The carrier of claim 2, wherein the first top panel is foldably connected to the second top panel.

4. The carrier of claim 3, wherein a cut extends between the first top panel and the second top panel and at least partially defines the first locking tab and the second locking tab.

5. The carrier of claim 4, wherein the cut is collinear with a fold line that foldably connects the first top panel and the second top panel.

6. The carrier of claim 2, wherein the at least one central panel comprises a first central panel foldably connected to the front panel and a second central panel foldably connected to the back panel, the locking opening comprises a first locking opening in the first central panel and a second locking opening in the second central panel.

7. The carrier of claim 6, wherein the first central panel and the second central panel are in face-to-face contact and the first locking opening and the second locking opening are overlapped.

8. The carrier of claim 7, wherein the first locking tab and the second locking tab extend through the overlapped first locking opening and second locking opening to lock the first top panel and the second top panel.

9. The carrier of claim 1, wherein the at least one opening comprises at least a first opening and a second opening, the first opening is configured to receive a first container of the plurality of containers and the second opening is configured to receive a second container of the plurality of containers.

10. The carrier of claim 9, wherein the at least one top panel comprises a first expansion feature extending from the first opening and a second expansion feature extending from the second opening, the first expansion feature facilitates tearing in the at least one top panel upon removal of the first container and the second expansion feature facilitates tearing in the at least one top panel upon removal of the second container.

11. The carrier of claim 4, further comprising a handle extending from the at least one central panel, the handle extends upwardly from the first top panel and the second top panel and is at least partially received in the cut.

12. The carrier of claim 1, wherein the at least one divider flap comprises a first divider flap and a second divider flap, the at least two container receiving spaces comprises three container receiving spaces.

13. The carrier of claim 12, wherein the first divider flap and the second divider flap are attached to the front panel and the three container receiving spaces are in the front portion of the carrier, the at least one divider flap comprises a third divider flap attached to the back panel and a fourth divider flap attached to the back panel, the third divider flap and fourth divider flap form three container receiving spaces in the back portion of the carrier.

14. A blank for forming a carrier for holding a plurality of containers, the blank comprising:

a plurality of panels for extending at least partially around an interior of the carrier formed from the blank and comprising at least one bottom panel, at least one top panel, a front panel, a back panel, at least one side panel, and at least one central panel for dividing the interior of the carrier formed from the blank into a front portion and a back portion; and at least one divider flap foldably connected to the at least one central panel and for extending to one of the front panel and the back panel to divide one of the front portion and the back portion into at least two container-receiving spaces in the carrier formed from the blank, the at least one top panel is foldably connected to at least one of the front panel and the back panel and includes at least one opening for receiving a container of the plurality of containers, the blank comprises locking feature including a locking tab in the at least one top panel and a locking opening in the at least one central panel for receiving the locking tab in the carrier formed from the blank.

15. The blank of claim 14, wherein the at least one top panel comprises a first top panel foldably connected to the front panel and a second top panel foldably connected to the back panel, the locking tab comprises a first locking tab extending from the first top panel and a second locking tab extending from the second top panel.

16. The blank of claim 15, wherein the first top panel is foldably connected to the second top panel.

17. The blank of claim 16, wherein a cut extends between the first top panel and the second top panel and at least partially defines the first locking tab and the second locking tab.

18. The blank of claim 17, wherein the cut is collinear with a fold line that foldably connects the first top panel and the second top panel.

19. The blank of claim 14, wherein the at least one central panel comprises a first central panel foldably connected to the front panel and a second central panel foldably connected to the back panel, the locking opening comprises a first locking opening in the first central panel and a second locking opening in the second central panel.

20. The blank of claim 19, wherein the first central panel and the second central panel are for being in face-to-face contact in the carrier formed from the blank and the first locking opening and the second locking opening are for being overlapped in the carrier formed from the blank.

21. The blank of claim 20, wherein the first locking tab and the second locking tab are for extending through the overlapped first locking opening and second locking opening to lock the first top panel and the second top panel in the carrier formed from the blank.

22. The blank of claim 14, wherein the at least one opening comprises at least a first opening and a second opening, the first opening is configured to receive a first container of the plurality of containers in the carrier formed from the blank and the second opening is configured to receive a second container of the plurality of containers in the carrier formed from the blank.

23. The blank of claim 22, wherein the at least one top panel comprises a first expansion feature extending from the first opening and a second expansion feature extending from the second opening, the first expansion feature facilitates tearing in the at least one top panel upon removal of the first container and the second expansion feature facilitates tearing in the at least one top panel upon removal of the second container.

24. The blank of claim 17, further comprising a handle extending from the at least one central panel, the handle is for extending upwardly from the first top panel and the second top panel and is at least partially received in the cut in the carrier formed from the blank.

25. The blank of claim 14, wherein the at least one divider flap comprises a first divider flap and a second divider flap, the first divider flap and the second divider flap are attached to the front panel and form three container receiving spaces in the front portion of the carrier formed from the blank, the at least one divider flap comprises a third divider flap attached to the back panel and a fourth divider flap attached to the back panel, the third divider flap and fourth divider flap form three container receiving spaces in the back portion of the carrier formed from the blank.

26. A method of forming a carrier for holding a plurality of containers, the method comprising:

obtaining a blank comprising a plurality of panels that comprises at least one bottom panel, at least one top panel, a front panel, a back panel, at least one side panel, and at least one central panel, at least one divider flap foldably connected to the at least one central panel and extending to one of the front panel and the back panel, the at least one top panel is foldably connected to at least one of the front panel and the back panel and includes at least one opening for receiving a container of the plurality of containers, the blank comprises locking features comprising a locking tab in the at least one top panel and a locking opening in the at least one central panel;

positioning the plurality of panels to extend at least partially around an interior of the carrier;

positioning the at least one central panel to divide the interior of the carrier into a front portion and a back portion;

positioning the at least one divider panel to extending to one of the front panel and the back panel to divide one of the front portion and the back portion into at least two container-receiving spaces; and activating the locking features to lock the at least one top panel, the activating the locking features comprises inserting the locking tab into the locking opening.

27. The method of claim 26, wherein the at least one top panel comprises a first top panel foldably connected to the front panel and a second top panel foldably connected to the back panel, the locking tab comprises a first locking tab extending from the first top panel and a second locking tab extending from the second top panel.

28. The method of claim 27, wherein the first top panel is foldably connected to the second top panel at a fold line, and a cut extends between the first top panel and the second top panel and at least partially defines the first locking tab and the second locking tab, the cut is collinear with the a fold line.

29. The method of claim 27, wherein the at least one central panel comprises a first central panel foldably connected to the front panel and a second central panel foldably connected to the back panel, the locking opening comprises a first locking opening in the first central panel and a second locking opening in the second central panel, the method comprises positioning the first central panel and the second central panel in face-to-face contact and overlapping the first locking opening and the second locking opening.

30. The method of claim 29, wherein activating the locking features comprises inserting the first locking tab and the second locking tab extend through the overlapped first locking opening and second locking opening to lock the first top panel and the second top panel.

31. The method of claim 26, wherein the at least one opening comprises at least a first opening and a second opening, the method comprises loading the plurality of containers into the interior of the carton and inserting a first container of the plurality of containers into the first opening and inserting a second container of the plurality of containers into the second opening.

32. The method of claim 31, wherein the at least one top panel comprises a first expansion feature extending from the first opening and a second expansion feature extending from the second opening, the first expansion feature facilitates tearing in the at least one top panel upon removal of the first container and the second expansion feature facilitates tearing in the at least one top panel upon removal of the second container.

33. The method of claim 28, wherein the blank further comprises handle features and the method comprises forming a handle from the handle features extending from the at least one central panel, and positioning the handle to extend upwardly from the first top panel and the second top panel and to be at least partially received in the cut.

34. The method of claim 26, wherein the at least one divider flap comprises a first divider flap and a second divider flap, the at least two container receiving spaces comprises three container receiving spaces, the method comprises attaching the first divider flap and the second divider flap to the one of the front panel and the back panel to form the three container receiving spaces in one of the front portion and the back portion of the carrier.

35. The method of claim 33, wherein the first divider flap and the second divider flap are attached to the front panel and the three container receiving spaces are in the front portion of the carrier, the at least one divider flap comprises a third divider flap and a fourth divider flap and the method comprises attaching the third and fourth divider flap to the back panel to form three container receiving spaces in the back portion of the carrier.

* * * * *